US007591053B2

(12) United States Patent
Bosisio et al.

(10) Patent No.: US 7,591,053 B2
(45) Date of Patent: Sep. 22, 2009

(54) MODULAR STRUCTURE FOR CEMETERY CONSTRUCTIONS

(75) Inventors: Riccardo Bosisio, Milan (IT); Barbara Bosisio, Milan (IT)

(73) Assignee: Giuseppe Bosisio S.r.L., Opera (Milano) (IT)

( * ) Notice: Subject to any disclaimer, the term of this patent is extended or adjusted under 35 U.S.C. 154(b) by 0 days.

(21) Appl. No.: 11/657,500

(22) Filed: Jan. 24, 2007

(65) Prior Publication Data

US 2007/0175110 A1 Aug. 2, 2007

(30) Foreign Application Priority Data

Jan. 27, 2006 (IT) ..... MI2006A0145

(51) Int. Cl.
*A61G 17/00* (2006.01)

(52) U.S. Cl. ..... 27/35; 52/134; 52/136; 211/85.16

(58) Field of Classification Search ..... 27/35; 52/128, 134, 136; 312/111; 211/85.16, 85.27, 211/189, 84; 220/4.33; 403/171, 217
See application file for complete search history.

(56) References Cited

U.S. PATENT DOCUMENTS 2,388,297 A * 11/1945 Slaughter ..... 428/53
3,351,366 A 11/1967 Edward
3,661,434 A 5/1972 Alster
3,754,805 A * 8/1973 Pangburn et al. ..... 312/111
3,841,726 A * 10/1974 Andros et al. ..... 312/111
4,073,100 A 2/1978 DiGiovanni
4,614,066 A * 9/1986 Koppenberg ..... 52/134
4,828,132 A * 5/1989 Francis et al. ..... 220/6
4,907,713 A * 3/1990 Walker ..... 220/4.33
5,452,817 A * 9/1995 Taravella et al. ..... 220/4.33
5,466,057 A * 11/1995 Blankenburg ..... 312/108
5,477,594 A * 12/1995 LePage ..... 27/1
5,638,973 A * 6/1997 Dewey et al. ..... 220/4.33
5,722,551 A * 3/1998 Cocciemiglio, Jr. ..... 220/4.33
5,996,828 A * 12/1999 Cheyn ..... 220/4.33

FOREIGN PATENT DOCUMENTS

GB 144813 A 6/1920

* cited by examiner

*Primary Examiner*—William L. Miller
(74) *Attorney, Agent, or Firm*—Robert C. Haldiman, Esq.; Husch Blackwell Sanders LLP

(57) ABSTRACT

The invention refers to a modular structure for cemetery constructions comprising at least one module of substantially parallelepiped form comprising four panels, each forming one wall of the module; at least one cover forming one end of the module; and four joints, each of them being engaged with two of the four panels forming two consecutive walls of the module. An advantage associated with the modular structure for cemetery constructions of the present invention consists of the possibility to set up on site the structure elements, panels, joints and covers, to be able to assemble a certain number of modules, whenever needed.

12 Claims, 3 Drawing Sheets

MODULAR STRUCTURE FOR CEMETERY CONSTRUCTIONS

CROSS-REFERENCE TO RELATED APPLICATIONS

This application claims priority to Italian application MI2006A000145 filed on Jan. 27, 2006.

STATEMENT REGARDING FEDERALLY SPONSORED RESEARCH

Not Applicable.

APPENDIX

Not Applicable.

BACKGROUND OF THE INVENTION

Field of the Invention

The present invention refers to a modular structure for cemetery constructions.

The modular structure of the present invention has a preferred though not exclusive application in the cemetery constructions composed of a series of niches or ossuaries (simply indicated with the term "niches" herein below).

As known, such cemetery constructions are generally composed of a building structure formed of a multiplicity of niches, having the same dimensions and placed adjacent and/or superimposed on each other. Generally, the niches are of parallelepiped form, delimited by four walls and by two covers placed at the opposite ends of such walls. Each wall of a niche is in contact with a corresponding wall of the adjacent niche, when such adjacent niche is present. The niches are generally arranged such that, for each niche, only one of such covers is visible from the outside. The niches are internally empty; by means of the removal of one of such covers, generally the one which is externally visible, it is possible to insert coffins or cinerary urns inside their interior.

In order to take best advantage of the vertical spaces, such cemetery constructions have upward extensions and are formed by a consistent number of rows of superimposed niches (it is possible to have up to six rows, each having a height of about eighty centimeters).

Generally, such cemetery constructions are concrete structures, made on site by means of the construction of wooden forms and the subsequent filling operation of the same with reinforced concrete casting. This building system has several disadvantages, such as for example: 1) the need to set up a building yard in the building zone inside a cemetery, producing troubling dirt, dust or dangerous conditions for cemetery visitors; 2) long building times; 3) the need to use cranes or other machinery for the movement of heavy materials; 4) making a final structure with very heavy weight; 5) not entirely satisfactory water-resistance, especially long-term.

Another solution for making such cemetery constructions is provided by prefabricated reinforced concrete tubes, which are positioned one close to each other and superimposed. In this case, there is the disadvantage of having to organize the transportation of such prefabricated materials, which is complex and costly given the considerable weight of the elements to be transported and, in addition, there is still the disadvantage of having to set up a building yard inside a cemetery, since the installation of the reinforced concrete tubes, even if prefabricated, requires the use of lime/cement. Moreover, there remain the abovementioned disadvantages related to the enormous weight of the final structure and the poor water-resistance.

SUMMARY OF THE INVENTION

Therefore, one problem underlying the present invention, in a first aspect, is that of providing the elements for making a cemetery structure which can be made on site, being easily adapted to the available spaces, without having to set up a complex building yard and use cranes or other machinery for the movement of material and for structure assembly.

In second aspect, a problem of the present invention is to realize a cemetery structure in a short period of time.

In another aspect, a problem of the present invention is to realize a cemetery structure having a reduced weight, maintaining at the same time the robustness, rigidity and impact strength features.

In a further aspect, a problem of the present invention is to reduce the space between one niche and the other one, either horizontally or vertically, therefore allowing to increase the number of niches which can be made within the available space.

Still in a further aspect, a problem of the present invention is to realize a cemetery construction having greater water resistance to conventional cemetery constructions, especially long-term.

The invention therefore regards a modular cemetery constructions according to claim 1. Preferred characteristics are indicated in the dependent claims.

In particular, the invention refers to a modular structure for cemetery constructions comprising at least one module of substantially parallelepiped form wherein the module comprises:

four panels, each forming a wall of the module;

at least one cover forming one end of the module; and four joints, each of them being engaged with two of said four panels forming two consecutive walls of said module.

In the present description and following claims, with the term "module of substantially parallelepiped form" is intended a module of parallelepiped form, of cubic form (i.e. a particular parallelepiped form wherein all the faces have the same dimensions), or a form which can be considered as such overall, even if not being perfectly parallelepiped or cubic. It is also intended that, in order to obtain such a module of substantially parallelepiped or cubic form, each of said four panels forms a wall of the module substantially arranged at 90° with respect to the two consecutive walls, wherein for "substantially at 90°" it is intended at 90° or with a percentage of difference from 90° equal to about 1-2%.

In the present description and following claims, with the term "modular structure" is intended a structure composed of a plurality of rows of said modules, each row being superimposed to the other, and wherein each of said row of module is composed of a plurality of said modules arranged one adjacent to the other. Preferably, each of said row of module is composed of the same number of modules, in such a way that the modular structure of the present invention has an overall parallelepiped form, composed of a certain number of rows and a certain number of columns of said modules.

Preferably, the modular structure according to the present invention is generically composed of 2-20 of said rows, more preferably 3-10, and 2-20 of said columns, preferably 3-10.

Typically, the lower row of said plurality of rows rests directly on a foundation, on a floor or on a base adapted to support the weight of the modular structure of the invention.

Therefore, a modular structure according to the present invention is composed of: a) external modules, i.e. modules which belong to one of the two columns or to one of the two rows at the ends of the modular structure, and b) central modules, i.e. modules which belong to one of the inner columns or to one of the inner rows and which are not external modules.

One advantage associated with the modular structure for cemetery constructions of the present invention consists in the possibility of setting up, on site, the structure elements—panels, joints and covers—to be able to assemble a certain number of modules every time they are needed.

Preferably, said panels, covers and joints are made of light material, such as for example a material chosen among fiberglass-reinforced plastic, aluminum and plastic materials, such as PVC and ABS, or in a material which ensures a certain robustness, such as for example iron and stainless steel. More preferably, said panels, covers and joints are made of fiberglass-reinforced plastic or aluminum, obtaining an optimal compromise of robustness, lightness of the material and long-term resistance.

By this way, the modular structure for cemetery constructions of the present invention has the advantage having a reduced weight with respect to the conventional in concrete cemetery constructions, maintaining at the same time the characteristics of robustness, rigidity and impact strength.

Moreover, the modular structure for cemetery constructions of the present invention has also the advantages of facilitating the transport of such elements, not requiring the use of bulky machinery for the preparation of a complex on-site building yard, reducing the building time, and reducing at the same time the disturbances affecting cemetery visitors.

Preferably, the four module panels have flattened rectangular form, i.e. a parallelepiped form with reduced thickness.

The section and thickness of the panels are of such dimensions to obtain the best compromise between the weight of the obtained modular structure and the load strength needs of the modular structure itself.

Preferably, said at least one module comprises at least two covers adapted to form the two opposite ends of the module.

Still more preferably, said at least two covers are of substantially square or rectangular form.

In a first embodiment, said at least two covers are of substantially square form and are particularly useful for making a "front modular structure", i.e. a modular structure wherein the modules have a greater depth with respect to their width and such that the zone corresponding to one of such substantially square covers only is visible from the outside. In this embodiment, the length of the side of said covers of substantially square form is substantially equal to the smaller dimension of the four module panels, said four panels all being equivalent.

In a second embodiment, said at least two covers are of substantially rectangular form and are particularly useful for making a "side modular structure", i.e. a modular structure composed of a plurality of modules wherein the modules have a lesser depth with respect to their width and such that the zone corresponding to one of such substantially rectangular covers only is visible from the outside. In this second embodiment, the dimensions (a,b) of said covers of substantially rectangular form are substantially equal, respectively, to one of the dimensions (a) of a pair of opposite panels and to one of the dimensions (b) of the other pair of opposite panels, said four panels being substantially two-by-two equal (every panel is substantially equal to its opposite). By this way, the modular structure of the present invention has the advantage that said at least two covers, both in the case they are of substantially square form or substantially rectangular form, are engaged with the four walls of the module in order to have an improved seal and an improved weatherability.

In a preferred embodiment, at least one of said four joints is further engaged with a third panel, which is arranged at 90° with respect to one of said two panels (herein indicated as the first panel) and at 180° with respect to the other of said two panels (herein indicated as the second panel). Therefore, said first and said second panel form two consecutive walls of a first module, while said first and third panel form two consecutive walls of a second module placed adjacent to said first module.

Consequently, this preferred embodiment of the present invention has a modular structure comprising a first and a second module placed adjacent to each other and having one wall in common formed by said first panel, with the advantage of reducing the space between two adjacent modules and better taking advantage of the space available for the making of the cemetery structure.

This embodiment in which at least one joint is engaged with three panels is particularly useful in the case in which said first and second module are of external type and in which said second and third panel form the external walls of said first and second module, where for external wall of an external module it is intended that wall which is not in common with an adjacent module.

In an additional preferred embodiment, at least one of said four joints is further engaged with a fourth panel arranged 90° with respect to said third panel. By this way, said third and fourth panel form two consecutive walls of a third module placed adjacent said second module, and moreover said fourth and said second panel form two consecutive walls of a fourth module placed adjacent to said third module and at the same time placed adjacent to said first module.

Consequently, in this particularly preferred embodiment of the present invention, the modular structure has the advantage of having at least one joint which is engaged with four panels, each of them forms a wall common to two adjacent modules. Of course, each of the four modules mentioned above will be completed with the use of panels and joints in such a number and position to obtain the required parallelepiped structure.

By this way the advantage of reducing the space between two adjacent modules, both horizontally and vertically, is obtained, allowing the making of a greater number of modules inside the available space.

This embodiment in which at least one joint is engaged with four panels is particularly useful for contributing to the formation of at least three modules. More in particular, it is useful for contributing to the formation of four modules, both in the case in which all the four modules are internal modules and in the case in which there are one or two internal modules and, respectively, three or two external modules.

In a preferred embodiment, said four panels are provided with a first coupling profile having U-shaped section, placed in external position with respect to at least one edge of the panel.

Preferably, said four panels are provided with a first and a second coupling profile having U-shaped section, in external position with respect to two opposite edges of the panel.

Preferably, the joints have a core portion having parallelepiped form with substantially square base.

More preferably, the dimension of the side of the core portion is substantially equal to the thickness of said panels and the length of said joints is substantially equal to the length of the edges of said panels.

By this way said panels and said joints are engaged so to obtain an alignment of joints and panels along all of their sides.

More preferably, said joints have at least two (more preferably, three, and still more preferably four) coupling profiles having U-shaped section, in external position with respect to the core.

In the preferred embodiment in which said joints have four coupling profiles, said joints have a substantially cross-shaped transverse section.

Still more preferably, the coupling profile of said panels is engaged with the coupling profile of said joints.

By this way, said panels and said joints sealingly engage.

In a more preferred embodiment, said joints have least one groove, preferably two grooves, at one of the parallel elements of said coupling profile having Ushaped section, said at least one groove being adapted with said coupling profile of said panels.

By this way, said panels and said joints are engaged to obtain an even better seal. Moreover, said grooves allow the collection of a possible structural glue employed for sealing the joints.

In an even more preferred embodiment, said joints have said coupling profiles having, at one end thereof, a rib or protuberance adapted to engage with a corresponding groove present on said coupling profile of said panels.

By this way, said panels and said joints engage to be self-locked, preventing the sliding of one with respect to the other, and allowing the modular structure to have an aligned and correct self-positioning.

In a preferred embodiment, said joints have a central hole.

Preferably, in said central hole, a threaded bush is foreseen to allow the positioning of support bosses of marble plates or the like.

In preferred embodiment, at least one of said covers of the modular structure of the present invention has two diagonal ribs for improving the lateral thrust strength of the entire modular structure and shearing strength.

Preferably, each of said covers has a connection edge adapted to engage with the edges of the walls of each module. By this way the gluing and sealing is allowed.

BRIEF DESCRIPTION OF THE DRAWINGS

Further characteristics and advantages of the present invention will be more evident from the following detailed description of a preferred embodiment thereof, made with reference to the attached drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
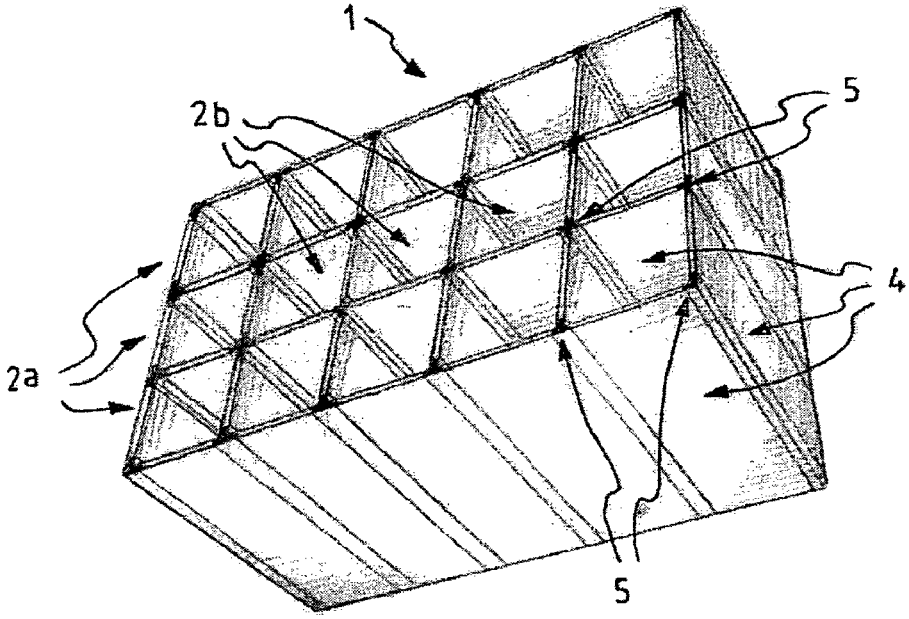
FIG. 1 represents a schematic view modular structure in accordance with the present invention.

A preferred embodiment of the present invention is shown in FIG. 1, wherein a modular structure 1 is shown for cemetery constructions, formed by three superimposed rows of modules 2, each of them being formed by five modules 2 placed adjacent one to each other, for a total of fifteen modules 2. All modules 2 have the same parallelepiped form and the same dimensions. As is evident from FIG. 1, the modules 2 of the modular structure 1 can be subdivided into external modules 2*a* and internal modules 2*b*; it is to be noted that—in the text and in the drawings—with the numbers 2 reference is made either to external modules 2*a* or internal modules 2*b*. Each of said modules 2, whether external 2*a* or internal 2*b*, is formed by four panels 4 forming the walls of the module 2, by four joints 5, and by two square form covers 6 forming the end and front wall of the module 2.

Still with reference to FIG. 1, each pair of adjacent modules 2 has a wall 4 in common. This characteristic leads to the advantage of reducing the total weight of the modular structure 1 and reducing to a minimum the space between one module 2 and the other one, with the consequence to be able to realize a structure 1 with a greater number of niches.

Figure 2:
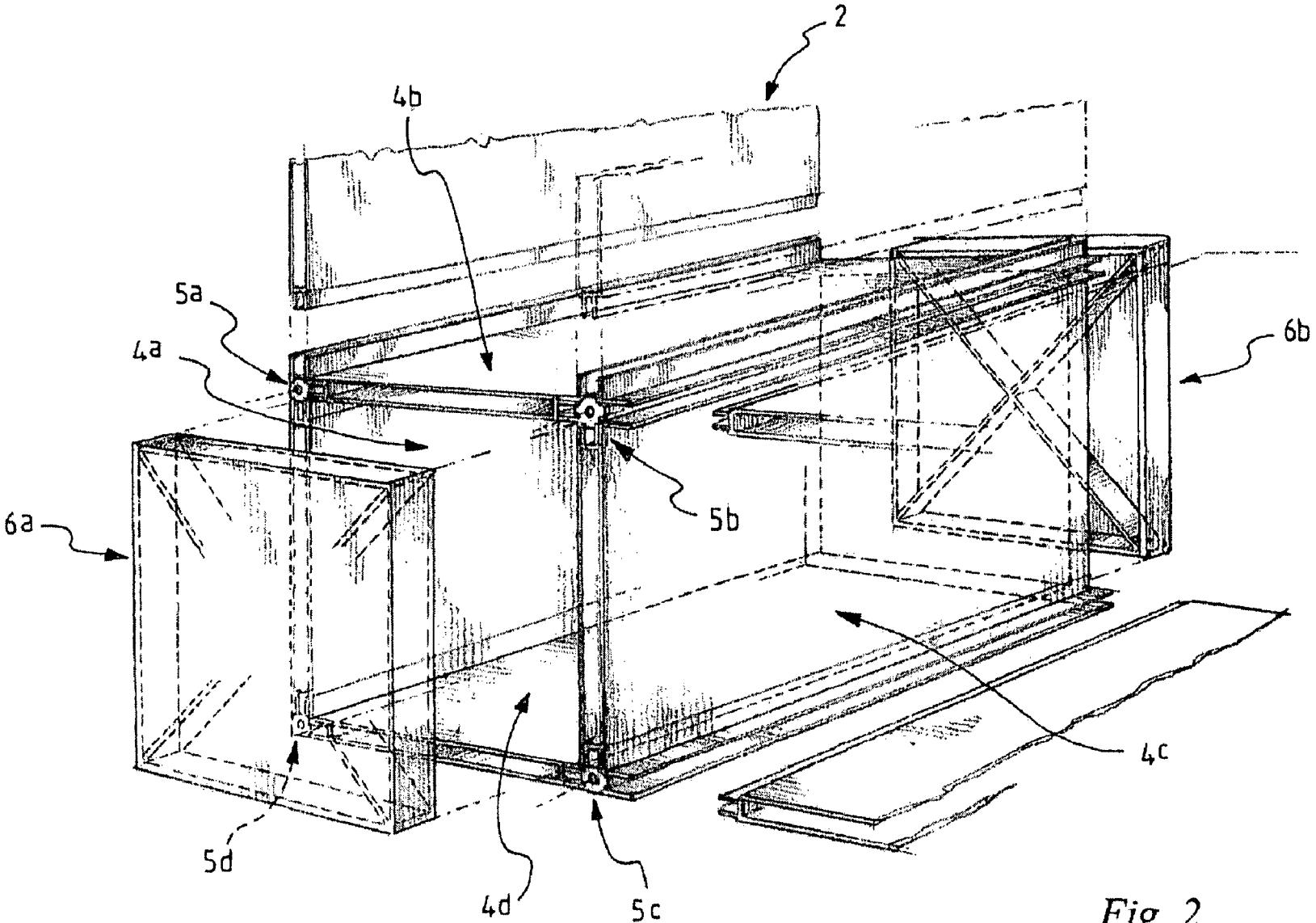
FIG. 2 represents a schematic view of one module of the modular structure in accordance with the present invention.

With reference to FIG. 2, the module 2, whether external 2*a* or internal 2*b*, comprises four panels 4*a*, 4*b*, 4*c* and 4*d*, four joints 5*a*, 5*b*, 5*c* and 5*d*, and two covers 6*a* and 6*b*; it is to be noted that—in the text and in the drawings—with the numbers 4, 5 and 6 reference is 20 indiscriminately made to the specific elements 4*a*, 4*b*, 4*c*, 4*d*, 5*a*, 5*b*, 5*c*, 5*d*, 6*a*, 6*b*. The four panels 4*a*, 4*b*, 4*c* and 4*d* form the walls of the module 2 and each of said panels is placed at 90° with respect to the subsequent panel. In particular, each joint 5 of the module 2 is engaged with two panels 4 forming two consecutive walls of the same module 2: in fact, the joint 5*a* is engaged with the panels 4*a* and 4*b*, the joint 5*b* is engaged with the panels 4*b* and 4*c*, the joint 5*c* is engaged with panels 4*c* and 4*d*, and the joint 5*d* is engaged with the panels 4*d* and 4*a*.

Figure 3A:
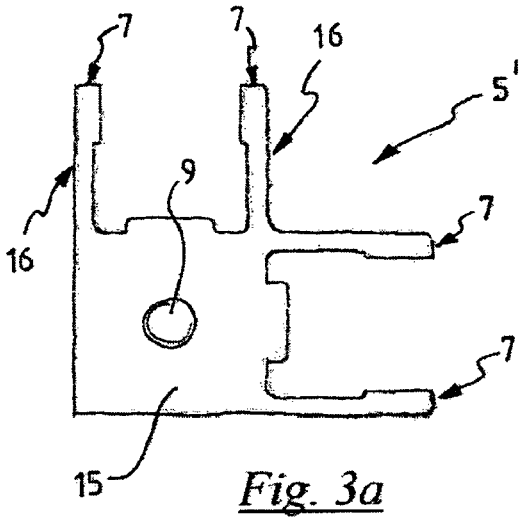
FIGS. 3*a*, 3*b* and 3*c* represent schematic views in section of three embodiments of joints in accordance with the modular structure of the present invention.
Figure 3B:
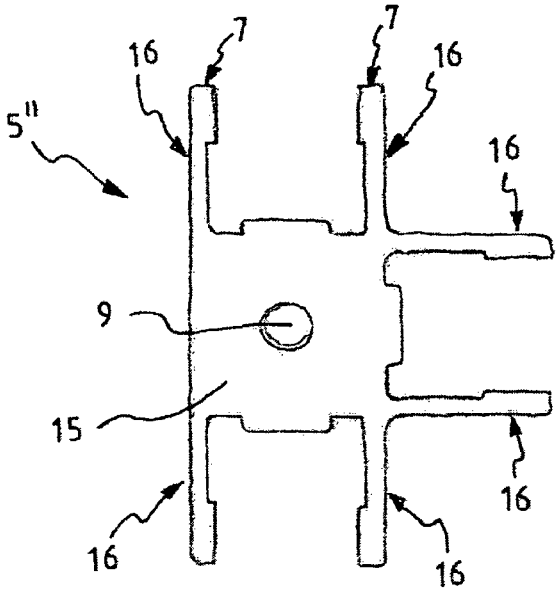
Figure 3C:
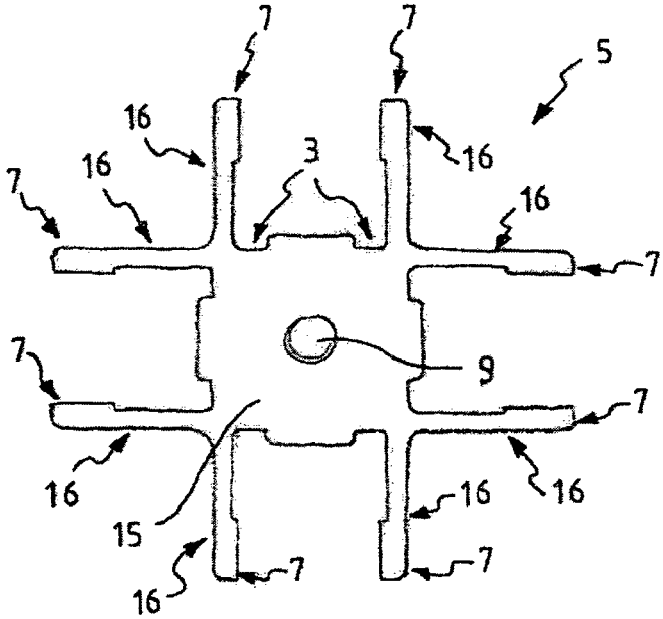
Figure 5:
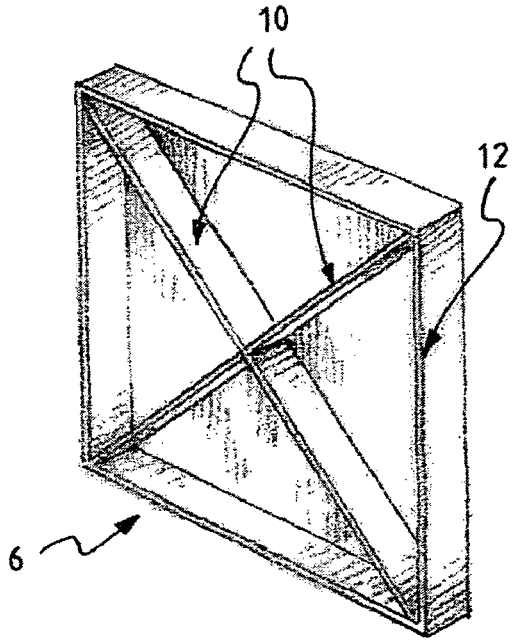
FIG. 5 represents a plan view of a module cover of the modular structure in accordance with the present invention.

In the FIGS. 3*a*, 3*b* and 3*c* several different embodiments of joints 5 are illustrated in plan view in accordance with the present invention. Each joint 5 comprises a central core 15, of square section, and two to four coupling profiles 16 having U-shaped section, in external position with respect to the core 15. In particular, the joint 5' shown in FIG. 3*a* comprises two coupling profiles 16; this can thus be engaged with two panels 4 of a same module 2 and is therefore particularly useful for making a corner of an external module 2*a* (see FIG. 1). The joint 5" shown in FIG. 3*b* comprises three coupling profiles 16; it can thus be engaged with two panels 4 of a same module 2 and with a third panel 4 of a second module 2, such third panel 4 being arranged respectively at 90° and at 180° with respect to the other two panels 4. It is particularly useful for making an external wall of an external module 2*a* (see FIG. 1). The joint 5 shown in FIG. 3*c* has four coupling profiles 16; it can thus be engaged with four panels 4, and is particularly useful for making up to maximum of four modules 2. In particular, it is useful for making internal modules 2*b* or non-external walls of external modules 2*a* (see FIG. 1).

For production simplicity and for inventory and assembly ease, a modular structure 1 for cemetery structures according to the present invention can be composed by modules 2 all having joint 5, shown in FIG. 3*c*, even for the positions where it would be more logical to use a joint 5' or a joint 5".

Therefore, in the case in which the joint 5 shown in FIG. 3*c* is intended to be engaged with only two panels 4 for making, for example, a corner of an external module 2*a*, such joint 5 will have two coupling profiles 16 which remain free, while in the case in which such joint 5 is intended to be engaged with three panels 4 for making, for example, an external wall of an external module 2*a*, such joint 5 will have one coupling profile 16 which remains free.

Figure 4:
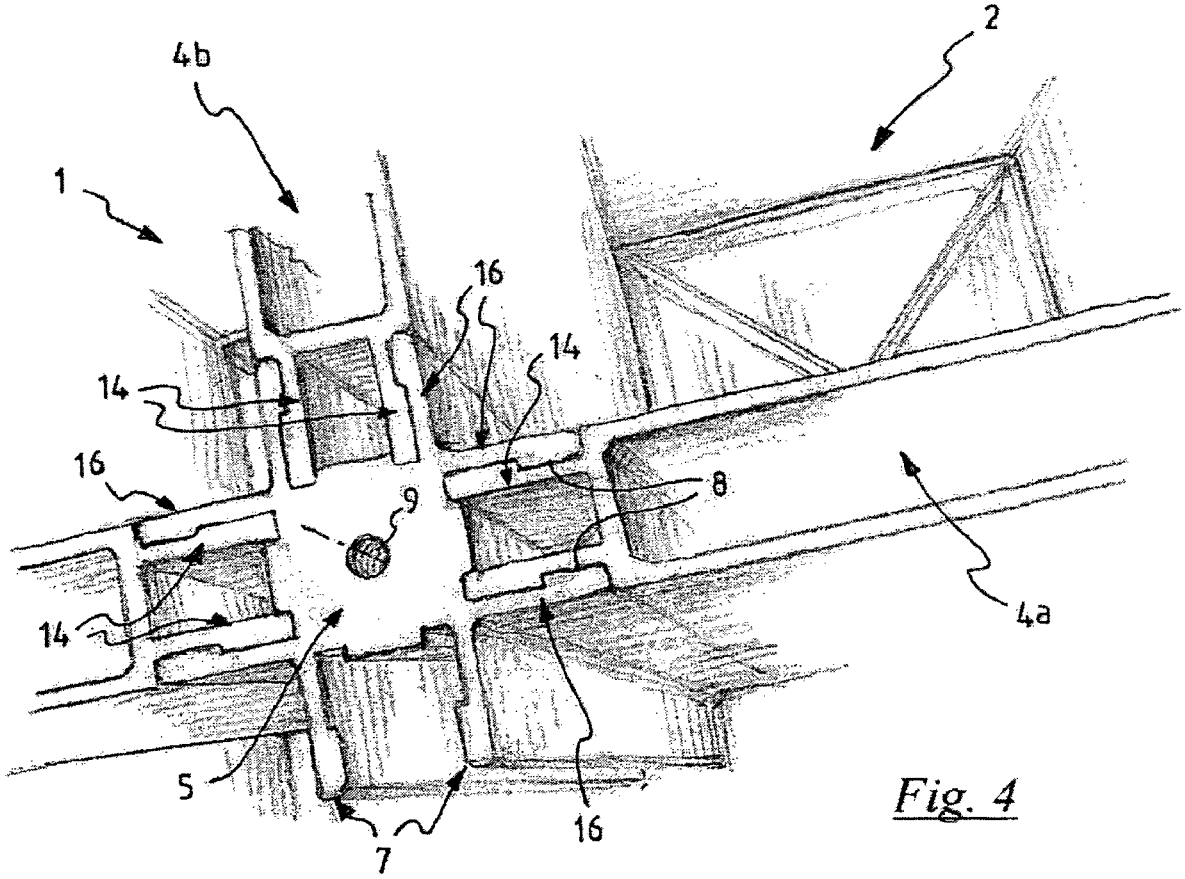
FIG. 4 represents a detailed schematic view joint like that of FIG. 3*c*, in engagement with four panels in accordance with the modular structure of the present invention.

As can be seen in FIG. 4, a preferred embodiment of a modular structure 1 of the present invention has the panels 4*a* and 4*b* of a module 2 of flattened rectangular form, i.e. parallelepiped with a very thin thickness. The panels 4 have a coupling profile 14 along one of their edges. Such coupling profiles 14 of the panels 4 are intended to engage with the coupling profiles 16 present on the joints 5.

As shown in FIG. 3*c*, the coupling profiles 16 present on the joint 5 are provided with two grooves 3. Such grooves 3 have the double object of collecting structural glue possibly employed for sealing the junctions and to allow the coupling profile 14 of the panels 4 to engage with joint 5 with even better results.

To further improve the engagement between the joints 5 and the panels 4, each joint 5 is provided with ribs 7 (FIGS. 3 and 4) present on the coupling profile 16 adapted to be engaged with corresponding grooves 8 present on the coupling profile 14 of the panels 4.

By this way, the panels 4 and the joints 5 engage to be self-locked, preventing the sliding of one towards the other one, and allowing the modular structure 1 to have an aligned and correct self-positioning.

Moreover, as is visible in FIG. 3, the joint 5 comprises a central hole 9 formed in the core 15, possibly provided with a threaded bush (not shown in the figures) to allow the positioning of support bosses for plates of marble, stone, granite or the like.

The modular structure 1 moreover comprises a cover 6, provided with two diagonal ribs 10 for improving the entire modular structure's lateral thrust strength and shearing strength. The cover 6 has also a connection edge 12 adapted to engage with the edges of the walls 4 of the module 2. By this way, gluing and sealing is permitted.

Naturally, the above-described embodiments must be intended as mere non-limiting illustrations of several possible embodiments of the modular structure of the present invention, it being clearly understood that any element pertaining to the structure itself can be changed the man skilled in the art in order to satisfy specific and contingent needs, while remaining in the scope of that described and claimed.

In particular, modular structures are also intended as falling within the scope of the present invention in which one module is composed of at least one element which overall has substantially the same form obtainable by single elements composing the module of the structure of the present invention and which carries out the same function of such assembled single elements.

What is claimed is:

1. A modular cemetery structure for a coffin comprising at least one module of substantially parallelepiped form wherein the module comprises:

four panels, each adapted to form one wall of said module, wherein said module is adapted to receive the coffin therein, each of said panels having a flattened rectangular form;

four joints, each of them being adapted to engage with two of said four panels to form two consecutive walls of the module;

at least one cover forming one end of said module;

a first U-shaped coupling profile on one of said panels or said joints, said first profile having a concave interior surface, said interior surface having one of a rib or a groove;

a second U-shaped coupling profile on the other of said panels or said joints, said second profile having an exterior surface, said exterior surface having the other of said rib or said groove; and said ribs and said grooves being dimensioned to engage one another such that two of said four panels join two of said four joints at two of said first profiles and two of said second profiles to form two consecutive walls of said module.

2. The modular cemetery structure according to claim 1, wherein said at least one cover comprises two covers adapted to form two opposite ends of said module.

3. The modular cemetery structure according to claim 1, wherein said at least one cover is of a substantially square or rectangular form.

4. The modular cemetery structure according to claim 1, wherein said two of said four panels are joined to said two of said four joints at 90 degrees.

5. The modular cemetery structure according to claim 1, wherein each of said four joints is further engaged with said panels at 90 degrees.

6. The modular cemetery structure according to claim 1, wherein at least two of said modules are adjacent or superimposed on each other and have a common wall composed of one of said panels.

7. The modular cemetery structure according to claim 1, wherein said joints have a core portion having a parallelepiped form with a substantially square base.

8. The modular cemetery structure according to claim 1, wherein said joints have at least two of said U-shaped coupling profiles in an external position with respect to a core portion.

9. The modular cemetery structure according to claim 1, wherein each of said joints further comprises four of said U-shaped coupling profiles, said four coupling profiles being in an external position with respect to a core portion such that said joints have a substantially cross-shaped transverse section.

10. The modular cemetery structure according to claim 1, wherein each of said joints has a central hole.

11. The modular cemetery structure according to claim 1, further comprising a mount in an end of each of said joints, said mount being disposed in relation to said cover such that a plate may be mounted over said cover.

12. The modular cemetery structure of claim 11 wherein said mount is hole.

* * * * *